United States Patent [19]

Murakami et al.

[11] Patent Number: 4,853,703

[45] Date of Patent: Aug. 1, 1989

[54] MICROSTRIP ANTENNA WITH STRIPLINE AND AMPLIFIER

[75] Inventors: Yuichi Murakami; Kiyokazu Ieda, both of Tokyo, Japan

[73] Assignee: Aisin Seiki Kabushikikaisha, Aichi, Japan

[21] Appl. No.: 26,705

[22] Filed: Mar. 17, 1987

[30] Foreign Application Priority Data

Mar. 17, 1986 [JP] Japan ..... 61-58692

[51] Int. Cl.[4] ..... H01Q 1/38

[52] U.S. Cl. ..... 343/700 MS; 343/701

[58] Field of Search ..... 343/700 MS, 701, 846; 333/247; 455/327, 333, 325, 291, 282; 330/277, 1 R, 286

[56] References Cited

U.S. PATENT DOCUMENTS

| | | | |
|---|---|---|---|
| 3,508,269 | 4/1970 | Snyder | 343/701 |
| 4,054,874 | 10/1977 | Oltman | 343/700 MS |
| 4,203,116 | 5/1980 | Lewin | 343/700 MS |
| 4,276,558 | 6/1981 | Ho et al. | 333/247 |
| 4,383,260 | 5/1983 | Ryan | 343/701 |
| 4,491,809 | 1/1985 | Noda et al. | 330/277 |
| 4,612,512 | 9/1986 | Powell et al. | 330/286 |
| 4,724,443 | 2/1988 | Nysen | 343/700 MS |
| 4,761,654 | 8/1988 | Zaghloul | 343/700 MS |

FOREIGN PATENT DOCUMENTS

| | | | |
|---|---|---|---|
| 77306 | 5/1983 | Japan | 343/700 MS |
| 90810 | 5/1983 | Japan | 330/277 |
| 137314 | 8/1983 | Japan | 330/277 |
| 59-52708 | 4/1984 | Japan . | |
| 77701 | 5/1984 | Japan | 333/247 |
| 59-91016 | 6/1984 | Japan . | |
| 112701 | 6/1984 | Japan | 333/247 |
| 171206 | 9/1984 | Japan | 333/247 |

*Primary Examiner*—Rolf Hille
*Assistant Examiner*—Michael C. Wimer
*Attorney, Agent, or Firm*—Sughrue, Mion, Zinn, Macpeak & Seas

[57] ABSTRACT

A high frequency amplifier is mounted in the immediate vicinity of a feeder of a microstrip antenna. A microstrip antenna includes a dielectric member and a grounded conductor member which is applied thereto. A second dielectric member is disposed on the side of the grounded conductor member which faces away from the dielectric member, and the high frequency amplifier is mounted on the surface of the second dielectric member which faces away from the grounded conductor member, and is connected to the feeder of the microstrip antenna. A transmission distance between the feeder and the high frequency amplifier, which represents an initial amplifier stage, is greatly reduced, thus drastically reducing disturbances caused by external noises and improving the noise figure of a receiving equipment.

8 Claims, 4 Drawing Sheets

MICROSTRIP ANTENNA WITH STRIPLINE AND AMPLIFIER

BACKGROUND OF THE INVENTION

The invention relates to an antenna device including a microstrip antenna.

A microstrip antenna comprises a dielectric member, a conductor member mounted on the dielectric member, and a ground conductor member mounted on the opposite surface of the dielectric member from the conductor member, and represents an antenna which utilizes a radiation loss of an open plane resonance circuit. Attention is now being directed to such microstrip antenna due to its low profile, reduced weight, compactness and ease of manufacture.

FIG. 3 illustrates one form of conventional microstrip antenna device. As shown, the device comprises a dielectric plate 110, one surface of which is applied with a radiating conductor sheet 120 formed by a copper foil while the opposite surface is applied with a ground conductor sheet 130 again formed by a copper foil. The device includes a feeder 121 in which a small hole 111 is formed extending through the dielectric plate 110, conductor sheet 120 and ground sheet 130. A connector 140, or more precisely, an external conductor associated therewith, is soldered to the ground sheet 130, and an internal conductor or core of the connector 140 is connected to a gold plated wire 141 which is soldered to the feeder portion of the radiating conductor sheet 120. The hole 111 is filled with an insulating material, not shown, thereby insulating the wire 141 from the ground sheet 130. The connector 140 is connected with a coaxial cable 150 which is in turn connected to a high frequency amplifier of a receiver unit.

In a receiver unit which is herein understood to be a circuit portion extending from the antenna feeder to an output device such as a loudspeaker, a cathode ray tube or the like, disturbances caused by external noises which are applied in a region between the antenna feeder and a first stage amplifier or the high frequency amplifier of the receiver unit have a great influence upon the noise figure of the receiving unit because they are amplified by the high frequency amplifier and every amplifier in an electrical path subsequent thereto. Obviously, the greater the length between the feeder and the initial amplifier, the greater the influence of these disturbances.

By way of example, when an antenna device such as shown in FIG. 3 is assembled into an outside panel of a vehicle with a coaxial cable 150 being used to provide a connection between the connector 140 and an input terminal of a receiver which is disposed within an instrument panel of the vehicle, a substantial length is required of the cable 150 and a received signal from the feeder 121 experiences an increased attenuation during its transmission through the connector 140 and through the cable 150 due to attenuation coefficients of the connector 140 and the coaxial cable 150. On the other hand, the coaxial cable is subject to disturbances of external noises over its full region including the connector 140, and this considerably degrades the noise figure of the receiving unit, i.e. between the antenna feeder 121 and an output source such as a loudspeaker or cathode ray tube unit.

SUMMARY OF THE INVENTION

It is an object of the invention to reduce disturbances caused by external noises which occur between a feeder of a microstrip antenna and a high frequency amplifier as much as possible.

The above object is accomplished in accordance with the invention by providing a second dielectric member on the opposite side of the ground conductor member from and in opposing relationship with the first mentioned dielectric member of the strip antenna, and mounting a high frequency amplifier which is connected to the feeder of the microstrip antenna on the opposite surface of the second dielectric member from the ground conductor member.

With this arrangement, the distance of transmission between the feeder of the microstrip antenna and the initial amplifier or the high frequency amplifier can be greatly reduced, thus substantially reducing any effect of disturbances caused by external noises.

Other objects and features of the invention will become apparent from the following description of an embodiment thereof with reference to the drawings.

DETAILED DESCRIPTION OF EMBODIMENTS

Figure 2A:
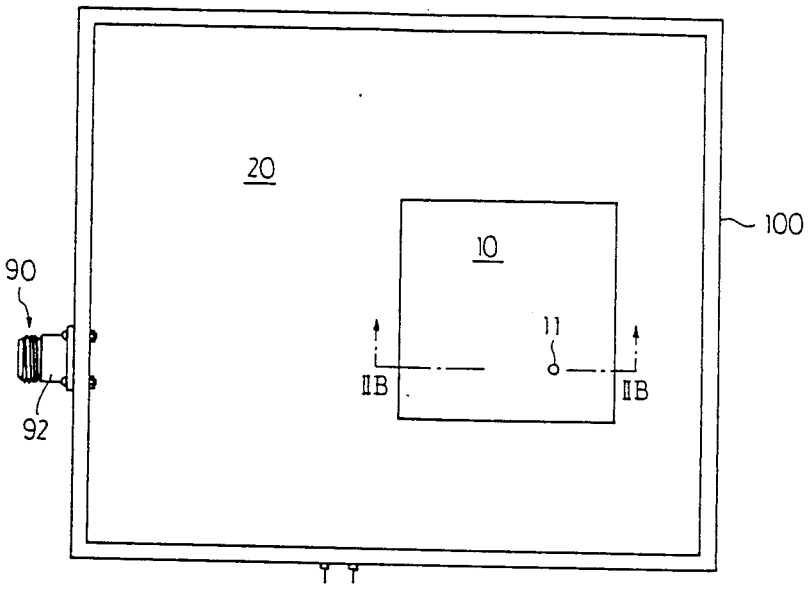
FIG. 2*a* is a front view of the antenna device shown in FIG. 1*a*.

Initially referring to FIG. 2*a*, an antenna device according to the invention includes a radiating conductor sheet 10 which is applied to a first dielectric plate 20. In this embodiment, the sheet 10 comprises a copper foil having a thickness of 35 μm applied to the first dielectric plate 20 which is formed by PTFE (polytetrafluoroethylene), or commonly referred to as "Teflon", glass substrate having a thickness of 1.588 mm.

Figure 2B:
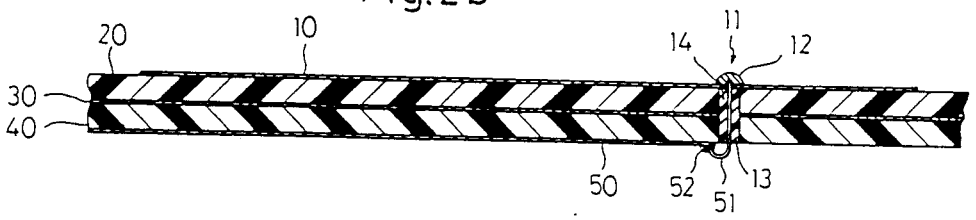
FIG. 2*b* is a cross section taken along the line IIB—IIB shown in FIG. 2*a*.
Figure 3:
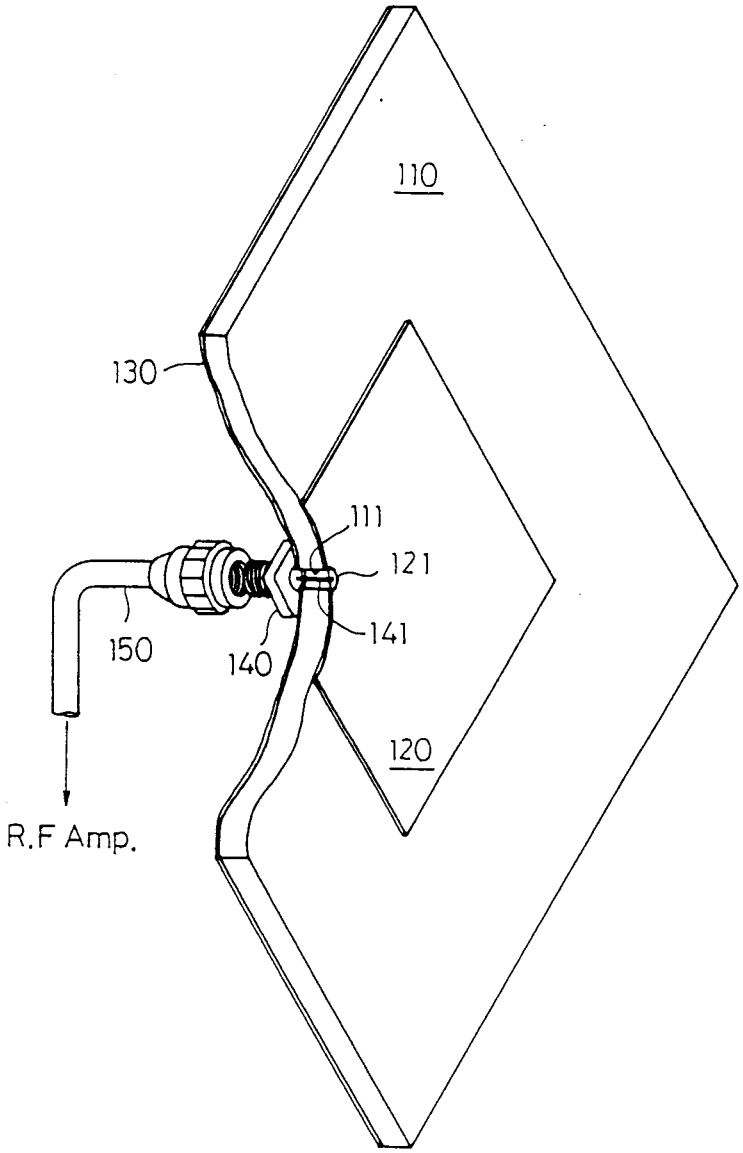
Fig. 3 PRIOR ART
FIG. 3 is a perspective view, partly broken away, of a conventional antenna device.

FIG. 2*b* shows a cross section taken along the line IIB—IIB shown in FIG. 2*a*. It will be noted that a ground conductor sheet 30 is applied to the entire surface of the first dielectric plate 20 which is located on the opposite side from the radiating conductor sheet 10. In this manner, the combination of the radiating conductor sheet 10, the first dielectric plate 20 and the ground conductor sheet 30 forms a microstrip antenna for use in a frequency range from 1.5 to 2 GHz. A second dielectric plate 40 is applied to the outer surface of the ground sheet so as to hold the latter between the both dielectric plates, thus forming a laminar structure. In the embodiment, the ground sheet 30 comprises a copper foil having a thickness of 35 μm and the second dielectric plate 40 comprises PTFE glass substrate in the same manner as the first dielectric plate 20.

A small hole 13 extends through the radiating conductor sheet 10, the first dielectric plate 20, the ground conductor sheet 30 and the second dielectric plate 40, which form together a laminar structure, and a metal golded wire 51 is supported therein as insulated from the ground sheet 30 by an insulating material 14. The end of the wire 51 located nearer the radiating conductor sheet is soldered to a feeder 11 thereof as shown at 12. The other end of the wire 51 is soldered to a strip conductor 50, to be mentioned later, as shown at 52.

Figure 1A:
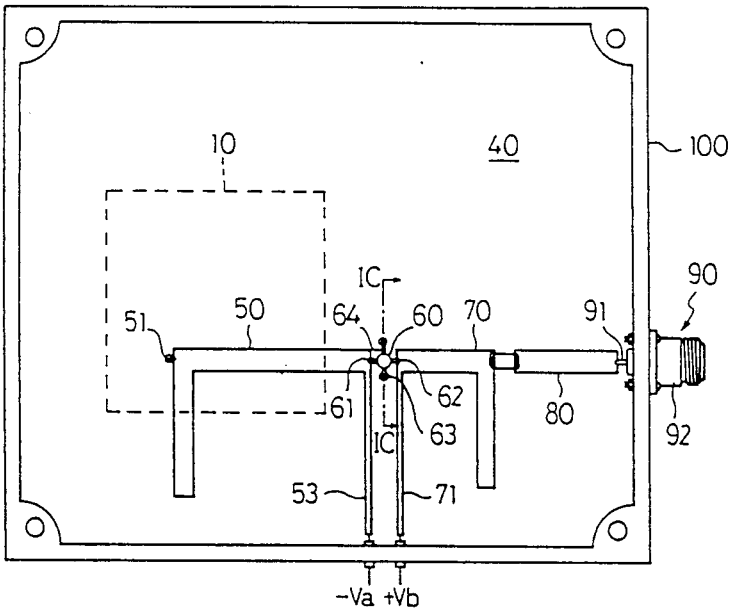
FIG. 1*a* is a rear view of an antenna device according to an embodiment of the invention.
Figure 1B:
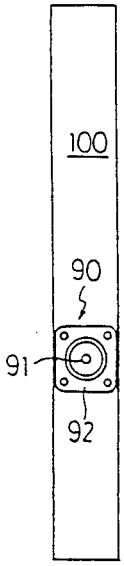
FIG. 1*b* is a right-hand side elevation of the device shown in FIG. 1*a*.

FIG. 1*a* shows a rear view of the antenna device. As will be noted, the strip conductor 50 which forms an input matching circuit, a field effect transistor 60, which may be 2SK571, a strip conductor 70 which forms an output matching circuit and a 50 Ω line strip conductor 80 are applied to the surface of the second dielectric plate 40 which is opposite from the ground conductor sheet 30. Each of the strip conductors 50, 70 and 80 comprises a copper foil having a thickness of 35 μm. A combination of the strip conductor 50, the second dielectric plate 40 and the ground conductor sheet 30 forms a strip line, which forms an input matching circuit which matches the feeder 11 of the microstrip antenna to a gate electrode 61 of the transistor 60. A combination of the strip conductor 70, the second dielectric plate 40 and the ground conductor sheet 30 forms another strip line, which forms an output matching line which matches a drain electrode 62 of the transistor 60 to a line having a characteristic impedance of 50 μ.

Figure 1C:
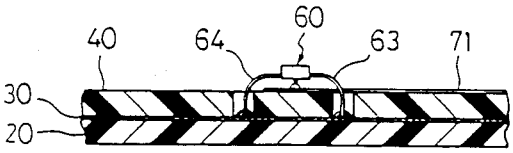
FIG. 1*c* is a cross section taken along the line IC—IC shown in FIG. 1*a*.

A first bias line 53 which is integral with the strip conductor 50 applies a bias voltage of −Va to the gate electrode 61 while a second bias line 71 which is integral with the strip conductor 70 applies a bias voltage of +Vb to the drain electrode 62 of the transistor 60. The transistor 60 has two source electrodes 63 and 64 which are both connected to the ground conductor sheet 30 as shown in FIG. 1*c* which indicates a cross section taken along the line IC—IC shown in FIG. 1*a*. In this manner, the transistor 60 forms a high frequency amplifier together with the input and the output matching circuit. In the present embodiment, the amplifier has a gain of approximately 15 dB. A combination of the strip conductor 80, the second dielectric plate 40 and the ground conductor sheet 30 forms a strip line having a characteristic impedance of 50 Ω.

The antenna device constructed in the manner mentioned above is fixedly mounted on a flange, not shown, of a frame 100, which comprises an electrically conductive material and which is connected to the ground conductor sheet 30. It will be seen that a connector 90 having a characteristic impedance of 50 Ω is secured to the right-hand side of the frame 100, as viewed in FIG. 1*a*, and includes an inner conductor 91 which is connected to the strip conductor 80 while its outer conductor 92 is threadably engaged with the frame 100. In other words, the outer conductor 92 is connected to the ground conductor sheet 30 through the frame 100.

A conductive cover member, not shown, is mounted on the frame 100 in opposing relationship with a surface of the second dielectric sheet 40 on which the strip conductors 50, 70, 80 and FET 60 are applied. The combination of the cover member and the frame which is formed of a conductive material constitutes together a shielded casing, preventing the high frequency amplifier and 50 Ω strip line from being subject to disturbances caused by external noises. A cover member, not shown, of a dielectric material is mounted on the frame 100 in opposing relationship with the radiating conductor sheet 10, functioning to protect the latter from dusts.

Figure 1D:
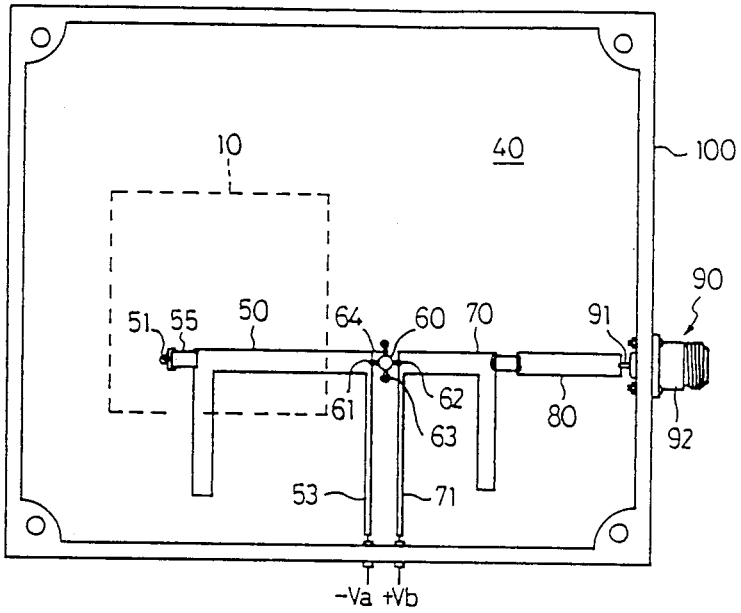
FIG. 1*d* is a rear view of a modification of the antenna device.

In the present embodiment, a gate bias −Va for FET 60 is applied to the first bias line 53 which is integral with the strip conductor 50 while a grounded conductor sheet 30 is connected to the frame 100. Accordingly, FET 60 may be destroyed in the event of occurrence of an electrical short-circuit between the radiating conductor sheet 10 and the frame 100 for some abnormality. As mentioned previously, a cover, not shown, is mounted on the front side of the frame 100 in order to avoid such interferences, but such interference may occur when the cover is not yet mounted as during a testing or mounting of the antenna device. Accordingly, in a modification of the invention shown in FIG. 1*d*, a chip capacitor 55 is interposed between the gold plated wire 51 and the strip conductor 50 and acts as a d.c. blocking capacitor which protects FET 60 by blocking a flow of a d.c. current which may be developed in the event of a short-circuit. To provide a sufficiently low impedance in a frequency range from 1.5 to 2 GHz in which the antenna device of the embodiment is used, the capacitor 55 has a capacitance on the order of 1,000 to 2,000 pF.

In the described embodiments, the radiating conductor sheet 10, the first dielectric sheet 20 and the grounded conductor sheet 30 form together a single microstrip antenna, but it will be evident that the invention can be equally applied to a microstrip antenna array having a plurality of radiating conductor sheets, with an increased number of corresponding high frequency amplifiers associated therewith.

As described, according to the invention, a high frequency amplifier is located in the immediate vicinity of a feeder of a microstrip antenna, thus greatly reducing a transmission distance between the feeder and the amplifier and thus drastically reducing disturbances caused thereon by external noises.

What we claimed is:

1. An antenna device comprising:

a microstrip antenna formed on a first dielectric member, said microstrip antenna including feeder means and further including a radiating conductor member disposed on a first major surface of said first dielectric member, and a grounded conductor member disposed on an opposing major surface of said first dielectric member;

a second dielectric member disposed on an opposite side of said grounded conductor member from said first dielectric member, such that said grounded conductor member is sandwiched between first and second dielectric members; and a high frequency circuit mounted on a surface of said second dielectric member which faces away from said grounded conductor member, said high frequency circuit comprising a high frequency amplifier and a strip conductor member constituting a strip line with said second dielectric member and said grounded conductor member for electrically matching said high frequency amplifier with said feeder means of said microstrip antenna.

2. An antenna device according to claim 1, in which said high frequency amplifier includes input matching means and output matching means.

3. An antenna device according to claim 2, in which said input matching means is connected to the feeder means of said microstrip antenna.

4. An antenna device according to claim 3, in which said input matching means comprises a strip line including a first conductor line member, said second dielectric member and said grounded conductor member.

5. An antenna device according to claim 4, in which said input matching means comprises a d.c. blocking means and is connected to the feeder means of said microstrip antenna through an electrical conduction path provided by said blocking means.

6. An antenna device according to claim 5, in which said blocking means comprises a capacitor.

7. An antenna device according to claim 2, in which said output matching means comprises a strip line including a second conductor line member, said second dielectric member and said grounded conductor member.

8. An antenna device comprising:

a microstrip antenna formed on a first dielectric member, said microstrip antenna including a radiating conductor member disposed on a first major surface of said first dielectric member, and a grounded conductor member disposed on an opposing major surface of said first dielectric member;

a second dielectric member disposed on an opposite side of the grounded conductor member form said first dielectric member, such that said grounded conductor member is sandwiched between said first and second dielectric members; and a high frequency circuit mounted on a surface of said second dielectric member which faces away from said grounded conductor member, said high frequency circuit being electrically connected to a feeder of said microstrip antenna, such that an electrical conduction path is provided between said high frequency circuit and said radiating conductor member, wherein said high frequency circuit comprises a high frequency amplifier and a strip conductor member constituting a strip line with said second dielectric member of electrically matching said high frequency amplifier with said feeder of said microstrip antenna.

* * * * *